United States Patent [19]

Thalenfeld

[11] Patent Number: 4,674,721

[45] Date of Patent: Jun. 23, 1987

[54] REMOVABLY MOUNTED MERCHANDISE DISPLAY HOOK

[75] Inventor: David R. Thalenfeld, Bear Creek, Pa.

[73] Assignee: Trion Industries Inc., Wilkes-Barre, Pa.

[21] Appl. No.: 880,806

[22] Filed: Jul. 1, 1986

[51] Int. Cl.[4] ..... E04G 3/00

[52] U.S. Cl. ..... 248/220.4; 211/59.1

[58] Field of Search ..... 248/220.4, 222.2, 220.3, 248/221.1, 221.2; 211/59.1, 104, 106

[56] References Cited

U.S. PATENT DOCUMENTS

| | | | |
|---|---|---|---|
| 2,841,353 | 7/1958 | Burdick . | |
| 2,842,264 | 7/1958 | Larson . | |
| 2,987,286 | 6/1961 | Alling . | |
| 3,198,449 | 8/1965 | Callanan . | |
| 3,250,235 | 5/1966 | McDonnell . | |
| 3,477,677 | 11/1969 | Hindley . | |
| 3,853,293 | 12/1974 | Larson . | |
| 4,351,440 | 9/1982 | Thalenfeld | 248/220.4 |
| 4,436,209 | 3/1984 | Thalenfeld . | |
| 4,452,360 | 6/1984 | Barnes | 211/59.1 |
| 4,474,351 | 10/1984 | Thalenfeld . | |
| 4,512,481 | 4/1985 | Thalenfeld | 248/222.2 X |
| 4,516,681 | 5/1985 | Jahel . | |
| 4,520,978 | 6/1985 | Taub | 248/222.2 X |

FOREIGN PATENT DOCUMENTS

| | | | |
|---|---|---|---|
| 2758582 | 7/1979 | Fed. Rep. of Germany | 248/220.4 |
| 1483450 | 8/1977 | United Kingdom | 248/220.4 |

*Primary Examiner*—J. Franklin Foss

*Attorney, Agent, or Firm*—Mandeville and Schweitzer

[57] ABSTRACT

A two-part merchandise display hook for apertured panel boards and the like comprising a base member and a hook member, where the hook member is of a known type having upper and lower outwardly extending wire-like arms joined at the back by a short vertical section. A short cross bar is mounted horizontally to the short vertical section and serves as a pivot mounting for the hook member. The base member is formed of sheet metal, shaped to provide cross bar mounting tabs with L-shaped slots for receiving the cross bar. An abutment panel is provided on the base member, which bears against the lower portion of the vertical wire section. The hook may be easily installed and removed from its cross bar engaging slots by predetermined upward tilting. The design nevertheless resists accidental dislodgement. The design is especially desirable for supporting heavy loads and/or where easy removal and replacement of the hook is desired.

4 Claims, 6 Drawing Figures

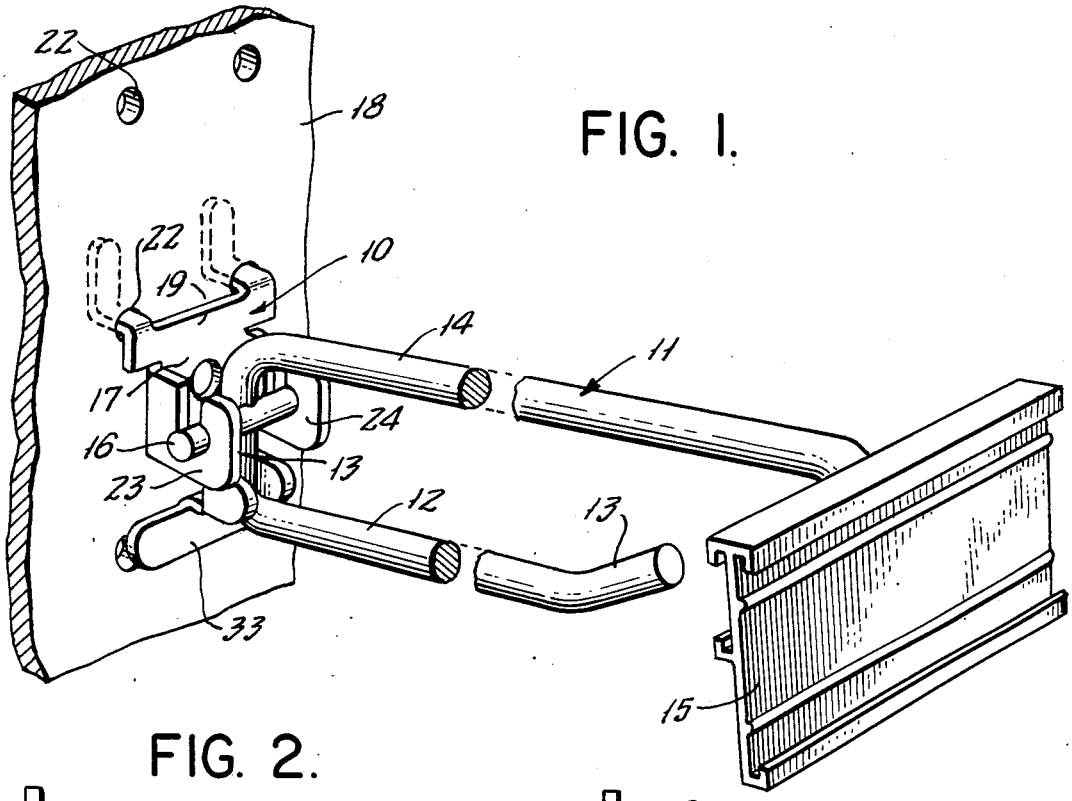
FIG. 1.
FIG. 2.
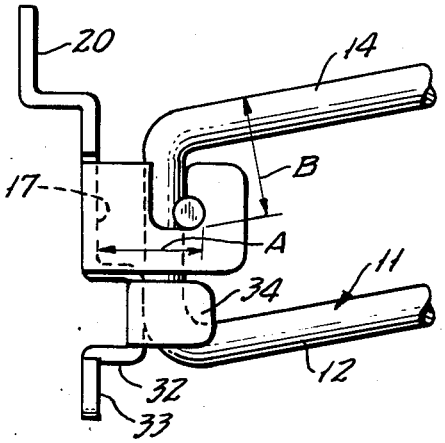
FIG. 3.
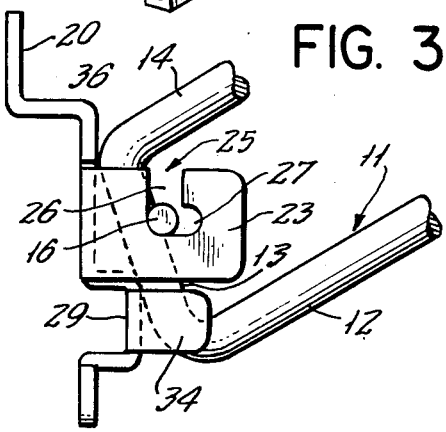
FIG. 4.
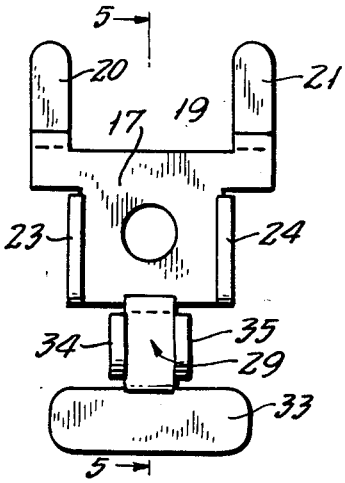
FIG. 5.
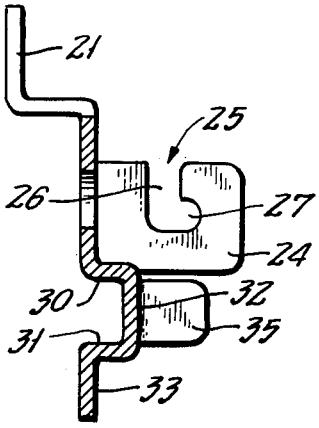
FIG. 6.
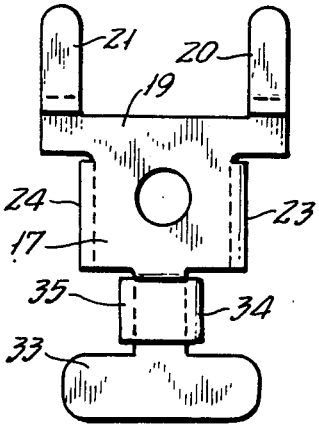

REMOVABLY MOUNTED MERCHANDISE DISPLAY HOOK

BACKGROUND AND SUMMUARY OF THE INVENTION

The present invention relates generally to merchandise display hooks, particularly of the type used in connection with apertured panel board merchandise displays, for example.

Widespread use is made of apertured panel board displays, in connection with point of purchase marketing of merchandise, particularly carded merchandise. A variety of devices are made available for the display of such merchandise, prominent among which is a two-part hook assembly, including a base element which can be mounted directly on the apertured panel board, and a wire-like hook device, which can be removably mounted in the base member.

A particularly desirable form of such two-part hook assembly of the type described is disclosed and claimed in the Thalenfeld U.S. Pat. No. 4,474,351, assigned to Trion Industries, Inc. and marketed by that company under its trademark "Tri-Scan". The device of the present invention seeks to incorporate insofar as possible the advantageous features of the patented device while at the same time incorporating certain significant and advantageous improvement features to render the device yet more desirable and more effective for certain specific end uses.

In particular, the device of the beforementioned Thalenfeld U.S. Pat. No. 4,474,351 incorporates a molded plastic base member in conjunction with a wire-like display element. The device of that patent, the disclosure of which is incorporated herein by reference, has many significant advantages, adapting the device for a wide variety of marketing applications. For certain end uses, however, especially where the wire-like hook element is unusually long and is designed to support heavy articles of merchandise, the use of a plastic base element tends to impose limitations, related particularly to the more limited (as compared to steel) strength of the plastic material desirably utilized in forming the base.

Accordingly, it is one of the objectives of the present invention to provide a novel and improved two-part merchandise display hook assembly, comprising separable base and hook elements, which incorporates many of the advantageous features of preexisting designs, such as that of the Thalenfeld U.S. Pat. No. 4,474,351, in which the base member may be economically formed of sheet metal material, rather than plastic, and at the same time provide for certain additional advantages in its features and functions.

It is acknowledged, of course, that the provision of shaped sheet metal bases for two-part merchandise hooks is, in a general sense, well known and, indeed, precedes the introduction of two-part hooks utilizing plastic bases. The device of the present invention does not derive its novelty from the utilization of a shaped sheet metal base, generally, but rather to a unique and specially advantageous form and shape of sheet metal base having unique structural features which, combined with a particular but known type of wire-like display element, provides a novel and highly advantageous display hook assembly.

In part, the device of the invention is designed to utilize the same form of merchandise support hooks as do assemblies utilizing molded plastic base members, such as the device of the beforementioned Thalenfeld U.S. Pat. No. 4,474,351. Thus, the hook devices may be utilized interchangeably with the known plastic bases of the beforementioned patent and/or with the shaped sheet metal bases of the present invention, depending on the customer's desired end use requirements.

Among the features of the invention, the shaped sheet metal base member provides for easy application and removal of the merchandise support hook element to and from the base member. At the same time, accidental dislodgement of the wire from its base member is difficult and unlikely.

The device of the invention additionally incorporates a desirable safety feature, providing for relatively free and unrestricted upward movement of the merchandise support hook, when accidentally bumped. Such relatively free movement does not, however, result in dislodgement of the hook from its mounting base.

Among the intended end uses of the new hook are in the support and display of large, heavy objects which not only exert considerable force on the supporting wire-like element, by reason of their sheer weight, but also, by reason of their size and bulk, may be located a substantial distance outward from the apertured panel board and thus may apply such weight through a relatively elongated lever arm. To this end, the shaped sheet metal base member is advantageously provided with a relatively horizontally elongated bearing foot along its lower edge, to provide greater and more effective distribution of bearing forces on the face of the apertured panel.

For a more complete understanding of the above and other features and advantages of the invention, reference should be made to the following detailed description of a preferred embodiment and to the accompanying drawing.

DESCRIPTION OF THE DRAWING

FIG. 1 is a perspective view of the new two part hook and base assembly of the invention, showing the same as normally mounted in an apertured panel display.

FIG. 2 is a fragmentary side elevational view of the hook and base assembly of FIG. 1.

FIG. 3 is a fragmentary side elevational view, similar to FIG. 2, but illustrating the hook member in a partially upwardly tilted position appropriate for assembly or disassembly of the support element and the base member.

FIGS. 4 and 6 are front and back elevational views respectively of the base member of the device of FIG. 1.

FIG. 5 is a cross sectional view as taken generally on line 5—5 of FIG. 4.

DESCRIPTION OF A PREFERRED EMBODIMENT

Referring now the drawing, and initially to FIG. 1 thereof, the reference numerals 10, 11 designate in a general way base and hook elements respectively of a two-part merchandise display hook assembly. The hook element 11 most advantageously is of the type shown and described in the Thalenfeld U.S. Pat. No. 4,474,351, comprising a wire-like element of generaly U-shaped configuration. A merchandise support element 12 extends forwardly and terminates in an upwardly directed end section 13. At the closed end of the "U" there is an integral, generally vertically extending wire-like back section 13, which joins with a forwardly extending upper section 14 extending generally parallel to and above the merchandise support element 12. The upper element typically mounts a plate (not shown) at its outer extremity, over which is received a length of extruded plastic 15, forming a label holder. Desirably, the label holder 15 serves as a safety guard with respect to the forward extremity 13 of the merchandise support element, and it provides a convenient facility for mounting an optically scannable Universal Product Code label or the like.

Secured to the vertical back section 13 of the U-shaped wire-like element is a cross bar 16. This is positioned on the front side of the wire section 13 and is typically welded thereto.

The hook element 11, as above described, is in general the same as that described in the Thalenfeld U.S. Pat. No. 4,474,351 and is designed and intended to be interchangeable with the plastic base member described and claimed in said patent.

Pursuant to particular aspects of the present invention, the base member 10 is formed of a uniquely shaped sheet metal member to provide a highly versatile and functional mounting for the wire-like display element 11. The base member 10 is formed of a single section of sheet metal, which includes a flat base panel 17 arranged to lie more or less flat against the front face of an apertured display panel 18. The base panel 17 is joined along its upper edge to a top panel section 19, which is of greater width than the base panel 17 and integrally mounts at its opposite side extremities rearwardly and upwardly extending L-shaped mounting lugs 20, 21. The lugs 20, 21 are of conventional configuration, adapted to be received in a pair of adjacent panel board openings 22 in the usual manner.

At the opposite side edges of the base panel 17 there are integrally connected a pair of outwardly extending bar mounting tabs 23, 24. The bar mounting tabs project generally at right angles to the base panel 17 and are spaced apart a distance substantially greater than the width of the wire element 11, but at least somewhat less than the overall length of the cross bar 16. In each of the bar mounting tabs there is provided an upwardly opening, generally L-shaped slot 25, having an upwardly extending portion 26 and a forwardly extending closed portion 27. The width of the slot sections 26, 27 is just slightly greater than the diameter of the cross bar 16, so that the cross bar can easily be inserted into and removed from the slot, but at the same time is substantially confined therein. As reflected particularly in FIG. 5, the forwardly extending portion 27 of the cross bar slot has a length preferably greater than the semi diameter of the cross bar 16 such that, when the cross bar is received therein, as in FIG. 2, it is effectively locked against upward movement.

Attached integrally to the lower edge 28 of the base panel 17 is an abutment section, generally designated by the numeral 29, which comprises an outwardly projecting first offset portion 30, which is joined with a downwardly extending abutment panel 32 which in turn is connected to a rearwardly projecting offset section 31.

Integrally joined with the rearward edge of the offset section 31 is horizontally extending bearing panel 33. The panel 33 lies generally in the same plane as the base panel 17 and serves to distribute the pressure of the loaded display hook over an area of the panel board 18.

Extending outwardly from the opposite side edges of the abutment panel 32 are spaced confinement tabs 34, 35. These tabs define between them a space sufficient to closely receive the wire of the display device 11 and thus serve not only to hold the display hook in a centered position with respect to the base member 10, but also confine the assembled merchandise hook against any twisting motion with respect to the base member.

As reflected in FIGS. 1 and 2, the relative geometry of the cross bar receiving slots 25, the abutment panel 32, and the cross bar and wire diameters is such that, when the display element 11 is installed in its normal position in the base member 10, the cross bar 16 bears forwardly in the slot 27, and the lower back portion of the vertical wire section 13 bears rearwardly against the abutment surface 32. In the illustrated arrangement, the geometry is such that the vertical back section 13 of the wire-like element 11 is approximately vertically disposed, in turn disposing the wire elements 12 and 14 at a slight upwardly inclined angle as desired for the display of merchandise. The two-part device is self-locking in this configuration.

In order to install or remove the display hook element 11, it is necessary to align the cross bar 16 with the vertical portion 26 of the cross bar engaging slots. This requires the display hook 11 to be tilted upwardly at a predetermined angle, substantially as shown in FIG. 3 allowing the cross bar to become aligned with the vertical slot portions. In this respect, the geometry of the abutment section 29 is such that the vertical wire section 13 normally is held in outwardly spaced relation to the base panel 17. This allows room for the vertical portion of the wire to tilt rearward sufficiently to accommodate assembly and removal of the display hook.

Desirably, upward tilting of the hook a lesser amount than shown in FIG. 3 will not withdraw the cross bar 16 far enough from the horizontal slot projection 27 to allow its vertical removal from the holding tabs 23, 24. Further tilting of the hook member to a substantially greater angle than that indicated in FIG. 3 causes the rounded upper rear portion 36 thereof to engage the front of the bearing panel 17, pushing the cross bar 16 back into the horizontal slot portion 27 to preclude disengagement from the base member. As a result, accidental dislodgement of the hook from the confinement of the cross bar engaging slots 25 is highly unlikely. At the same time, the ability of the device to accommodate free upward tilting of the display hook 11 allows the device to respond easily to being accidently bumped into. The device is nevertheless very stable in normal use, inasmuch as the weight of the hook and its contents provides substantial leverage tending to pivot the cross bar 16 forward, into its restraining slot portions 27, located at relatively widely spaced points in the respective bar mounting tabs 23, 24.

In the illustrated form of the invention, the geometry of the display hook element 11 and base 10 is such that the dimension "A", from the front of the base panel 17 to the front of the slot portion 27 is approximately equal to the distance "B" from the bottom of the cross bar to the top of the upper wire section 14. This allows the display hook member 11 to be pivoted into a substantial vertical position.

As reflected particularly in FIG. 1, the length of the cross bar 16 is slightly greater than the width of the cross bar mounting tabs 23, 24 such that, during assembly, the cross bar may be easily engaged with the tabs 23, 24 and guided into a position in which the wire element 11 is confined between the tabs 34, 35. Once the wire element is thus confined, it is centered between the cross bar supporting tabs 23, 24, with the ends of the bar projecting slightly outward, beyond each side. The device of the invention is particularly advantageous in that it enables as-is utilization of "standard" wire-like elements already in use in hook assemblies of the Thalenfeld U.S. Pat. No. 4,474,351. In particular, but not by way of limitation, the present invention may also employ a merchandise hook as shown in FIG. 12 of that patent, comprising a single outwardly extending wire member for merchandise, and a short downwardly extending wire, mounting a cross bar above its lower end. The described single-wire hook is similar in structure to the hook of FIG. 1 hereof, but with the lower wire 12 removed and the upper wire modified to support merchandise rather than serve as a label holder. The invention extends the usefulness of the previously patented hook in providing for significantly heavier load support and easy assembly/disassembly.

In the device of the invention, the base member 10 is uniquely shaped to provide multiple functional cooperation between the base panel 17, the cross bar receiving slots 25, the abutment panel 32 and the confining tabs 34, 35. These cooperative elements are configured to be produced from a relatively simple sheet metal stamping yet provide for a high degree of cooperative interaction. For example, interaction between the abutment panel 32, the slots 25 and the base panel 17 enable the cross bar 16 to be freely dropped into an assembled relation, or lifted out for disassembly, by positioning the wire-like element in a particular limited rotational orientation relative to the base. The wire-like element is otherwise freely rotatable relative to the base, but cannot be disengaged therefrom in any but the predetermined rotational orientation. This provides for a high degree of safety, by allowing the hook to freely react in displays when externally engaged.

When the wire-like display element is mounted on the base and in its normal display position, the cross bar 16 is forcibly urged into its confining recesses 27 by the normal pivoting action of the element against the abutment panel 32. If accidentally dislodged, the device tends forcibly to return to the normal position under the influence of gravity.

It should be understood of course that the specific form of the invention herein illustrated and described is intended to be representative only, as certain changes may be made therein without departing from the clear teachings of the disclosure. Accordingly, reference should be made to the following appended claims in determining the full scope of the invention.

I claim:

1. A merchandise display hook or the like of the type having a base member and a hook member, said hook member being formed of wire-like material and having an outwardly extending merchandise support section, a vertically extending back section and a cross bar secured rigidly to said back section and extending transversely from opposite sides thereof, the improvement in said base member characterized by (a) said base member comprising a section of sheet metal cut and shaped to form a base panel provided adjacent its upper portion with a pair of integral, rearwardly and upwardly extending, L-shaped mounting lugs, (b) said base panel having generally vertically disposed opposite side edges, (c) hook-engaging tabs joined integrally with said base panel along said opposite side edges and extending outwardly therefrom generally at right angles to said base panel, (d) said hook-engaging tabs being spaced apart horizontally a distance substantially greater than the width of said wire-like material but less than the length of said cross bar, (e) said hook engaging tabs each having an upwardly opening slot therein for reception and mounting of a hook member, (f) said slots opening at the upper edges of said hook engaging tabs and having closed ends within said tabs below and forward of said open ends, (g) said slots being of a width only slightly greater than the width of said cross bar and being adapted for the reception and confinement of said cross bar, (h) said base member further comprising an abutment section joined integrally with the lower edge of said base panel, (i) said abutment section comprising a first offset section extending generally forward from the lower edge of said base panel, an abutment panel extending downward from said first offset section, and a second offset section extending generally rearward from said abutment panel, (j) said abutment panel being positioned substantially forward of said base panel and both rearward and below the lower forward extremities of said cross bar receiving slots, (k) said abutment panel being positioned to bear against the lower portions of the back section of said hook member to maintain said hook member in a merchandise display position when said cross bar is received in said slots, (l) said cross bar being insertable into and removable from said slots only when said hook member is tilted upward at a predetermined angle from said merchandise display position, (m) the lower forward extremities of said slots being offset forward of said back panel sufficiently to accommodate upward tilting of said hook member beyond said predetermined positon.

2. A merchandise display hook according to claim 1, further characterized by (a) said cross bar receiving slots being of L-shaped configuration inlcuding upwardly opening vertical portions and forwardly projecting horizontal portions, (b) said horizontal portions terminating forwardly of said abutment panel and lockingly receiving said cross bar when said hook member is in its normal display position.

3. A merchandise display hook according to claim 1, further characterized by (a) confining tabs extending forward from opposite sides of said abutment panel, (b) said confining tabs being spaced apart a distance not substantially greater than the diameter of the wire forming said hook member.

4. A merchandise display hook or the like of the type having a base member and a hook member, said hook member being formed of wire-like material and having an outwardly extending merchandise support section, a vertically extending back section and a cross bar secured rigidly to said back section and extending transversely from opposite sides thereof, the improvement in said base member characterized by (a) said base member comprising a section of sheet metal cut and shaped to form a base panel, (b) a pair of hook-engaging tabs joined integrally with said base panel and extending outwardly therefrom generally at right angles to said base panel, (c) said hook-engaging tabs being spaced apart horizontally a distance substantially greater than the width of said wire-like material but less than the length of said cross bar, (d) said hook engaging tabs each having a slot therein for reception and mounting of a hook member, (e) said slots being of a width only slightly greater than the width of said cross bar and being adapted for the reception and confinement of said cross bar, (f) said base member further comprising an abutment section joined integrally with said base panel, (g) said abutment section including an abutment panel positioned substantially forward of said base panel and both rearward and below the lower forward extremities of said cross bar receiving slots, (h) said abutment panel being positioned to bear against the lower portions of the back section of said hook member to maintain said hook member in a merchandise display position when said cross bar is received in said slots, (i) said cross bar being insertable into and removable from said slots only when said hook member is tilted upward at a predetermined angle from said merchandise display position, and (j) confinement tabs extending outward from said base member and closely straddling the lower back portions of said hook member.

* * * * *